US011749917B2

(12) United States Patent
Belisle et al.

(10) Patent No.: US 11,749,917 B2
(45) Date of Patent: Sep. 5, 2023

(54) POWER FEEDER DEVICE WITH INCREASED CREEPAGE PATH BETWEEN ADJACENT TERMINAL PAIRS

(71) Applicant: Hamilton Sundstrand Corporation, Charlotte, NC (US)

(72) Inventors: Francis C. Belisle, Beloit, WI (US); Nhia Yang, Roscoe, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 18 days.

(21) Appl. No.: 17/501,738

(22) Filed: Oct. 14, 2021

(65) Prior Publication Data

US 2023/0119582 A1 Apr. 20, 2023

(51) Int. Cl.

| | |
|---|---|
| ***H01R 9/24*** | (2006.01) |
| ***H01R 25/16*** | (2006.01) |
| ***H01R 4/36*** | (2006.01) |

(52) U.S. Cl.

CPC ..... *H01R 9/2416* (2013.01); *H01R 4/36* (2013.01); *H01R 25/162* (2013.01)

(58) Field of Classification Search

CPC ..... H01R 9/2416; H01R 4/36; H01R 25/162
See application file for complete search history.

(56) References Cited

U.S. PATENT DOCUMENTS

| | | | | |
|---|---|---|---|---|
| 3,512,121 | A | 5/1970 | Bergeron | |
| 4,133,598 | A | 1/1979 | Kuntzsch | |
| 5,203,724 | A | 4/1993 | Casey | |
| 5,876,224 | A | 3/1999 | Chadbourne | |
| 7,097,502 | B2 | 8/2006 | Landis et al. | |
| 7,527,523 | B2 | 5/2009 | Yohn et al. | |
| 8,647,159 | B2 * | 2/2014 | Steeves | H01R 4/305 439/798 |
| 9,509,068 | B2 * | 11/2016 | Hansen | H01R 9/226 |
| 9,537,363 | B2 | 1/2017 | Thompson et al. | |

(Continued)

FOREIGN PATENT DOCUMENTS

| | | | |
|---|---|---|---|
| EP | 3822998 | A1 | 5/2021 |

OTHER PUBLICATIONS

Extended European Search Report, of the European Patent Office, dated Feb. 27, 2023, in corresponding European Patent Application No. 22201415.1.

*Primary Examiner* — Travis S Chambers
(74) *Attorney, Agent, or Firm* — Locke Lord LLP; Daniel J. Fiorello; Gabrielle L. Gelozin

(57) ABSTRACT

A power feeder device can include a base having a mounting portion and a plurality of connector structures extending from the mounting portion and spaced apart relative to each other to form a respective gap therebetween. Each connector structure can be configured to receive a respective pair of terminals to electrically connect the respective pair of terminals within connector structures and to block a line of sight between adjacent pairs of terminals. The device can also include a cover configured to mate with the base to enclose each of the plurality of connector structures and to increase a length of a creepage path between each pair of terminals by at least partially inserting into each gap between the connector structures. The base and the cover can be configured to form a terminal opening on each lateral side when assembled to allow pass-through of a conductor and/or portion of each terminal.

19 Claims, 8 Drawing Sheets

(56) References Cited

U.S. PATENT DOCUMENTS

| | | | | |
|---|---|---|---|---|
| 9,755,332 | B1 | 9/2017 | Ganta et al. | |
| 9,882,294 | B1 | 1/2018 | Jeong et al. | |
| 10,243,283 | B2 | 3/2019 | Nagano | |
| 10,938,129 | B2 | 3/2021 | Belisle | |
| 11,322,803 | B2 * | 5/2022 | O'Neil | H01R 43/00 |
| 2007/0207638 | A1 * | 9/2007 | Wiant | H01R 25/162<br>439/76.2 |
| 2010/0084205 | A1 | 4/2010 | Tarchinski et al. | |
| 2013/0169083 | A1 | 7/2013 | Meyer | |
| 2020/0287302 | A1 * | 9/2020 | Shen | H01R 4/38 |

* cited by examiner

POWER FEEDER DEVICE WITH INCREASED CREEPAGE PATH BETWEEN ADJACENT TERMINAL PAIRS

FIELD

This disclosure relates to electrical power feeder systems.

BACKGROUND

The present standard for electrical connections of high amperage power feeders to electrical equipment are electrical power connections provided by threaded bolts (or terminal studs). These have a single bolt (threaded fastener) and are compatible with power levels of hundreds of amperes and large wire gauge feeders (for example 4/0 AWG, aka 0000 American Wire Gauge). With new aerospace electrical power levels being 400 amperes and above, and wire feeders being specified in cross sectional area and not AWG, a single traditional fastener point will not be sufficient for electrical conduction clamping area or mechanical support of the large conductors in high vibration environments. A single bolt joint electrical interface becomes too small for electrical conduction and for thermal conduction area to move heat away from the electrical component for high power amperages. The electrical conduction area needs to have good mechanical loading distributed across the electrical interfaces for low resistance and to prevent mechanical movement due to vibration or thermal cycling.

These electrical bolted joints (e.g., aircraft power feeders to equipment terminals) typically have a simple dielectric cover placed over the electrical joints for voltage protection and typically have large openings for tolerances of the mechanical clearances. The cover features primarily provide protection from accidental personnel or tool physical contact with electrical connections. The covers often do not prevent personnel from reaching under or around the cover and touching the electrical feeder or component connections. Traditional terminals and covers provide protection against large Foreign Object Debris (FOD) items, but not against small or thin FOD elements of materials, and do not provide robust break down physical protection for aerospace high voltage. Also, with the increase of aircraft voltages (above 500V), the dielectric air gap spacing and surface creepage spacing (along a dielectric surface material between conductors) in the typical cover designs are not adequate to provide electrical break down protection for high altitudes.

Such conventional methods and systems have generally been considered satisfactory for their intended purpose. However, there is still a need in the art for improved terminal block power feeder connector devices. The present disclosure provides a solution for this need.

SUMMARY

A power feeder device can include a base having a mounting portion and a plurality of connector structures extending from the mounting portion and spaced apart relative to each other to form a respective gap therebetween. Each connector structure can be configured to receive a respective pair of terminals to electrically connect the respective pair of terminals within connector structures and to block a line of sight between adjacent pairs of terminals. The device can also include a cover configured to mate with the base to enclose each of the plurality of connector structures and to increase a length of a creepage path between each pair of terminals by at least partially inserting into each gap between the connector structures. The base and the cover can be configured to form a terminal opening on each lateral side when assembled to allow pass-through of a conductor and/or portion of each terminal. In certain embodiments, at least one of the terminals of the respective pair of terminals can be a bus bar extending from a bus bar chassis and the base and/or the cover can form a creepage barrier that extend into a chassis wall opening of the bus bar chassis to increase a length of a chassis creepage path from the respective pair of terminals to the bus bar chassis.

The creepage barrier can be planar in shape in at least one portion, for example. Any suitable shape (e.g., a conduit shape) is contemplated herein. In certain embodiments, the creepage barrier can include a first portion that extends from the base and a second portion that extends from the cover.

Each of the plurality of connector structures includes first and second barrier walls extending from the mounting portion and axially spaced apart to block a line of sight to an adjacent connector structure. Each of the plurality of connector structures can include first and second lateral walls extending from the mounting portion and laterally spaced apart. Each of the first and second lateral walls can connect respective first and second barrier walls, and extend only partially the height of each barrier wall. Each lateral wall can define a cutout shape that forms a portion of a respective terminal opening. In certain embodiments, the cutout shape can be semi-circular.

In certain embodiments, each of the plurality of connector structures can define a base plate pocket between the barrier walls and the lateral walls. Each plate pocket can be configured to receive a respective base plate for a respective pair of terminals to mount to. The base plate pocket can be defined laterally inward from the lateral walls and separated from the lateral walls by a separator portion.

In accordance with at least one aspect of this disclosure, a system an include a bus bar chassis having a chassis wall opening and a bus bar extending through the chassis wall opening, and a power feeder device, e.g., as disclosed herein, e.g., as described above. For example, the at least one of the terminals of the respective pair of terminals can be the bus bar extending from the bus bar chassis. The base and/or the cover can form a creepage barrier that extend into the chassis wall opening of the bus bar chassis to increase a length of a chassis creepage path from the respective pair of terminals to the bus bar chassis.

In certain embodiments, the power feeder device is mounted to the bus bar chassis. In certain embodiments, the other terminal of the respective pair of terminals can include a connecting terminal configured to connect to the bus bar, the system further comprising the connecting terminal.

The bus bar and/or the connecting terminal can include at least one alignment system such that bus bar and connecting terminal only mate in a single orientation. In certain embodiments, the alignment system can include at least one protruding alignment feature on the bus bar and/or connecting terminal and a receiving alignment feature that mates with the at least one protruding alignment feature on the other of the bus bar and/or connecting terminal.

In certain embodiments, the system can include a plurality of pairs terminals. Each pair can include a respective bus bar extending from the bus bar chassis and a respective connecting terminal configured to connect to each respective bus bar. In certain embodiments, the alignment system can be configured such that if any connecting terminal is misplaced on an incorrect bus bar, the misplaced connecting terminal will be misaligned relative to a respective terminal opening of the terminal openings formed by the base and cover such that the cover and base cannot install together as the misplaced connecting terminal blocks closure.

In accordance with at least one aspect of this disclosure, a power feeder system can include a base, a cover configured to mount with the base to enclose around at least a pair of terminals such that the base and cover form a terminal opening on each lateral side thereof, a bus bar terminal, a connecting terminal mounted to the bus bar terminal, and an alignment system configured to align the bus bar terminal and the connecting terminal relative to each other, wherein the cover cannot close around the base with the bus bar terminal and connecting terminals enclosed therein unless the bus bar terminal and the connecting terminal are aligned by the alignment system. The alignment system can include any suitable embodiment of an alignment system disclosed herein, e.g., as described above.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
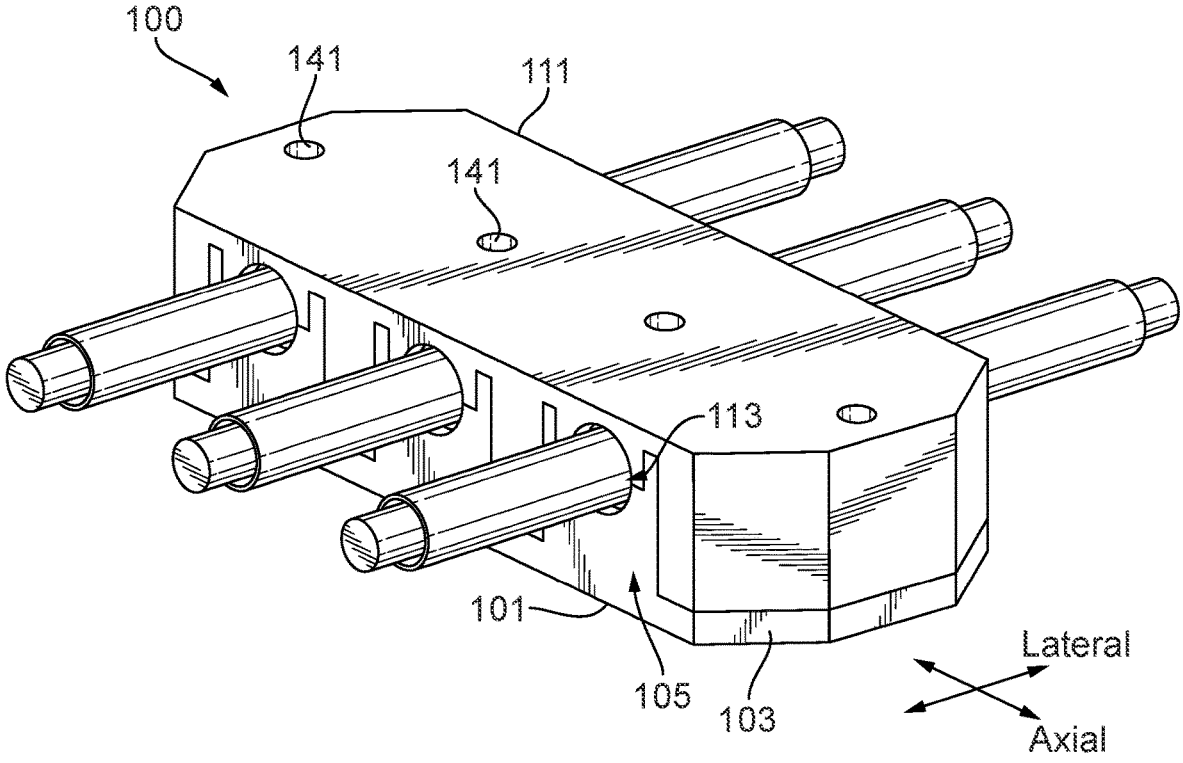
FIG. 1 is a perspective view of an embodiment of a device in accordance with this disclosure, shown having terminals connected together therein and extending from the device.
Figure 2:
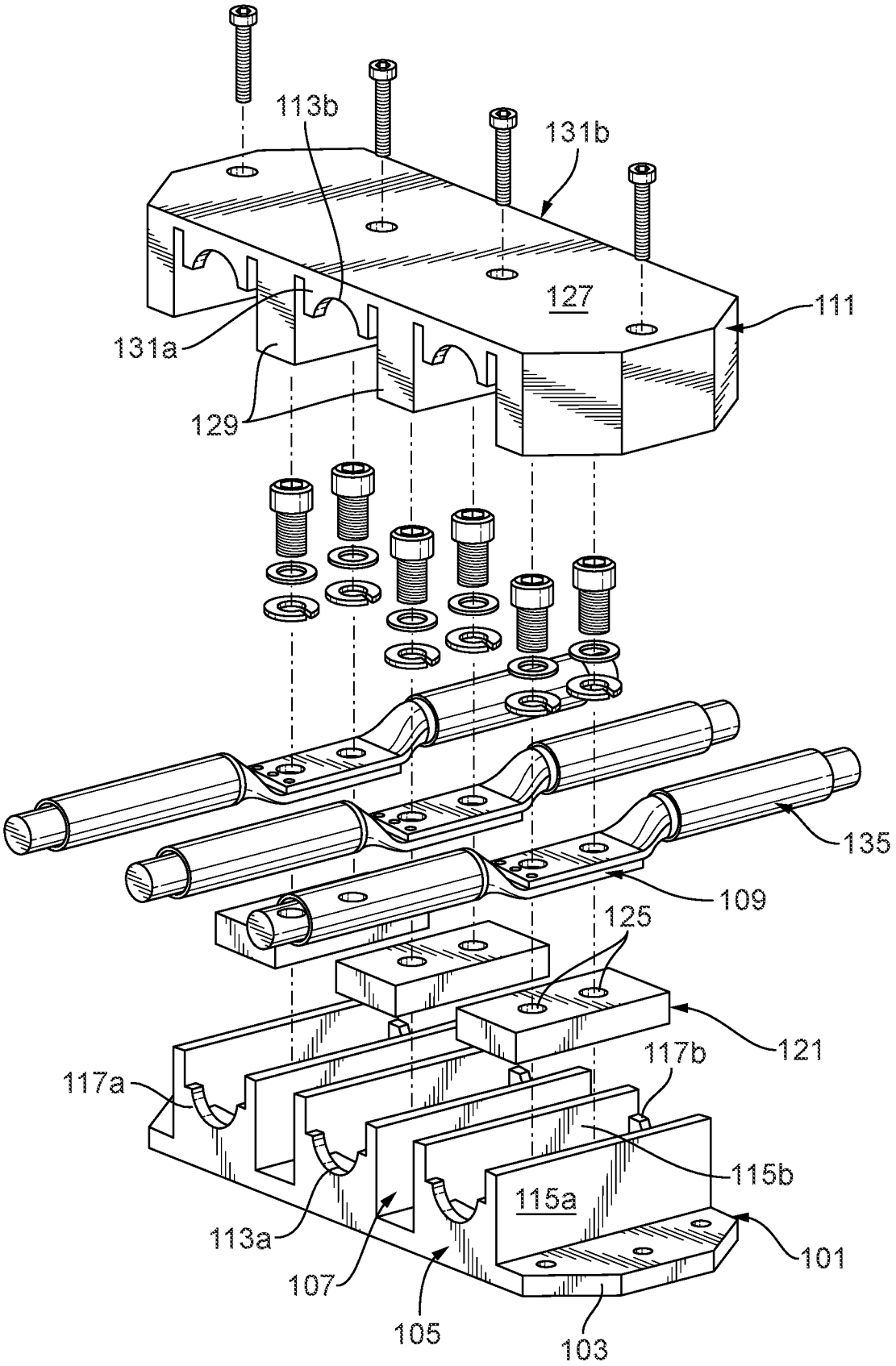
FIG. 2 is an exploded view of the embodiment of FIG. 1.

Reference will now be made to the drawings wherein like reference numerals identify similar structural features or aspects of the subject disclosure. For purposes of explanation and illustration, and not limitation, an illustrative view of an embodiment of a device in accordance with the disclosure is shown in FIG. 1 and is designated generally by reference character 100.

Other embodiments and/or aspects of this disclosure are shown in FIGS. 2-10. Certain embodiments described herein can be used to interconnect high voltage terminals, e.g., for aerospace applications. Any other suitable use and/or advantage is contemplated herein.

Referring generally to FIGS. 1-6, a power feeder device 100 can include a base 101 having a mounting portion 103 and a plurality of connector structures 105 extending from the mounting portion 103 and spaced apart relative to each other to form a respective gap 107 therebetween. Each connector structure 105 can be configured to receive a respective pair of terminals 109 to electrically connect the respective pair of terminals within connector structures and to block a line of sight between an adjacent pair of terminals 109.

Figure 5:
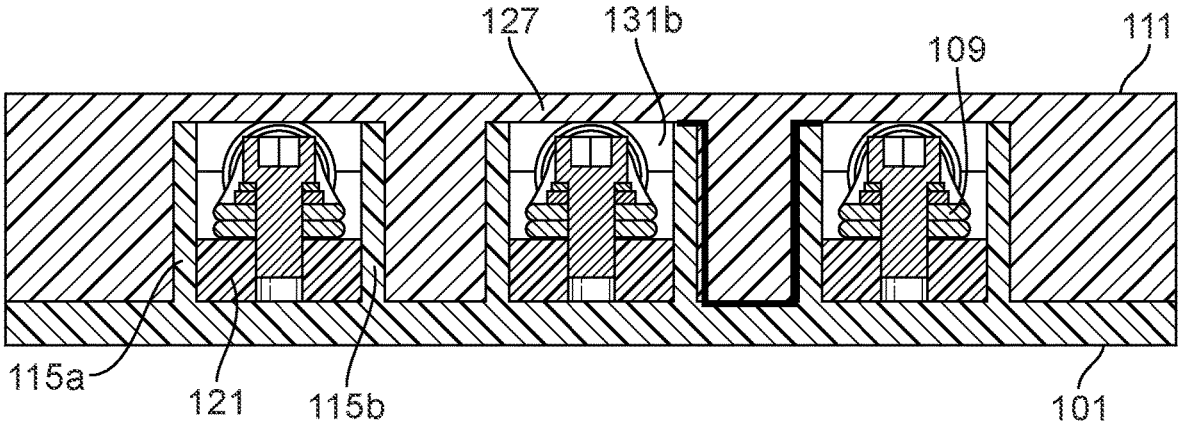
FIG. 5 is a cross-sectional view of the embodiment of FIG. 1 taken along an axial axis.

The device 100 can also include a cover 111 configured to mate with the base 101 to enclose each of the plurality of connector structures 105 and to increase a length of a creepage path (e.g., as shown in FIG. 5) between each pair of terminals 109 by at least partially inserting into each gap 107 between the connector structures 105. The base 101 and the cover 111 can be configured to form a terminal opening 113 on each lateral side when assembled to allow pass-through of a conductor (e.g., a wire or rod) and/or portion of each terminal 119.

Each of the plurality of connector structures 105 can include first and second barrier walls 115*a*, 115*b* extending (e.g., vertically) from the mounting portion 103 and axially spaced apart to block a line of sight to an adjacent connector structure 105 (e.g., as shown). Each of the plurality of connector structures 105 can include first and second lateral walls 117*a*, 117*b* extending (e.g., vertically) from the mounting portion 103 and laterally spaced apart (e.g., at the edges of base 103 as shown).

Each of the first and second lateral walls 117*a*, 117*b* can connect respective first and second barrier walls 115*a*, 115*b*. In certain embodiments, each lateral wall 117*a*, 117*b* can extend only partially the height of each barrier wall 115*a*, 115*b* (e.g., as shown).

Each lateral wall 117*a*, 117*b* can define a cutout shape 113*a* that forms a portion of a respective terminal opening 113. For example, the cutout shape 113*a* can be semi-circular (e.g., such that the terminal opening 113 is circular as shown).

Figure 3:
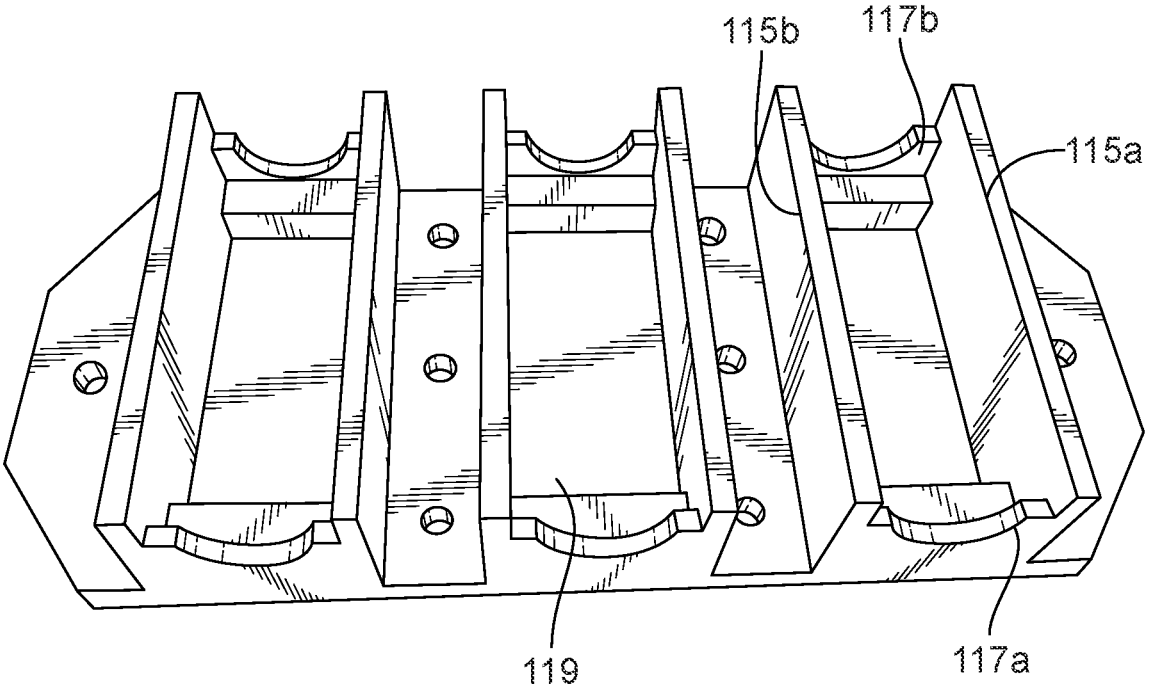
FIG. 3 is a perspective view of a base of the embodiment of FIG. 1.

As shown in FIG. 3, for example, each of the plurality of connector structures 105 can define a base plate pocket 119 between the barrier walls 115*a, b* and the lateral walls 117*a, b*. Each plate pocket 119 can be configured to receive a respective base plate 121 for a respective pair of terminals 109 to mount to. The base plate pocket 119 can be defined laterally inward from the lateral walls 117*a, b* (e.g., between the lateral walls 117*a, b* as shown) and separated from the lateral walls 117*a, b* by a separator portion 123*a, b*.

In certain embodiments, a base plate 121 can be disposed in each base plate pocket 119. The base plate 121 can include a plurality of threaded holes 125 (e.g., two as shown) for receiving a fastener (e.g., screws with washers as shown) to electrically connect and retain a respective pair of terminals 109. In certain embodiments, the base 101 can be made of an electrical insulator (e.g., strong rigid plastic) and the base plate 121 can be made of an electrical conductor (e.g., metal). In certain embodiments, the base plate 121 can be insulative.

The cover 111 can define a top surface 127 and a plurality of insert walls 129 extending from the top surface 127 configured to insert into and fill the gap 107 between adjacent connector structures 105. The cover 111 can define first and second side walls 131*a, b* extending from the top surface 127 and configured to fit between a respective pair of barrier walls 115*a,b* and to abut respective first and second lateral walls 117*a, b* to seat on the lateral walls 117*a, b* to enclose the connector structure 105 at lateral ends thereof around a conductor and/or portion of each terminal 109. The first and second side walls 131*a, b* can define an opening shape 113*b* configured to partially form the terminal opening 113. The cover 111 can be configured to position the opening shape 113*b* and the cutout shape 113*a* to complement each other to form the terminal opening 113 when the cover 111 is installed on the base 101, e.g., as shown in FIGS. 1 and FIG. 5.

The top surface 127 can contact a top of the barrier walls 115*a, b* and can extend across the connector structure 105 in the axial direction to enclose the connector structure 105 at a top thereof. In certain embodiments, an electrically insulating seal (e.g., sleeve 135) can be disposed at least partially in the terminal opening 113 to seal around a conductor and/or portion of each terminal 109. Any other suitable seal is contemplated herein to seal any gaps between the conductor/terminal and the cover and/or base in the terminal opening 113, for example.

In certain embodiments, the plurality of connector structures 105 can include three connector structures 105 for a three phase electrical system (e.g., as shown). Any other suitable number is contemplated herein (e.g., two).

The base 101 can include a plurality of mounting holes 137 defined through the mounting portion 103 for mounting to a structure. In certain embodiments, the base 101 can include a plurality of cover mounting holes 139 for receiving a fastener (e.g., cover screws as shown) to attach the cover 111. At least some of the cover mounting holes 137 can be axially located in each gap 107 between each the connector structures 105. As shown, the cover 111 can include a one or more cover through holes 141 configured to align with the cover mounting holes 137 to allow a fastener to attach the cover 111 to the base 101.

The cover 111 and the base 101 can be made of any suitable materials. For example, the cover 111 and the base 101 can be made of a dielectric material. In certain embodiments, the cover 111 can be more flexible than the base 101.

Figure 4:
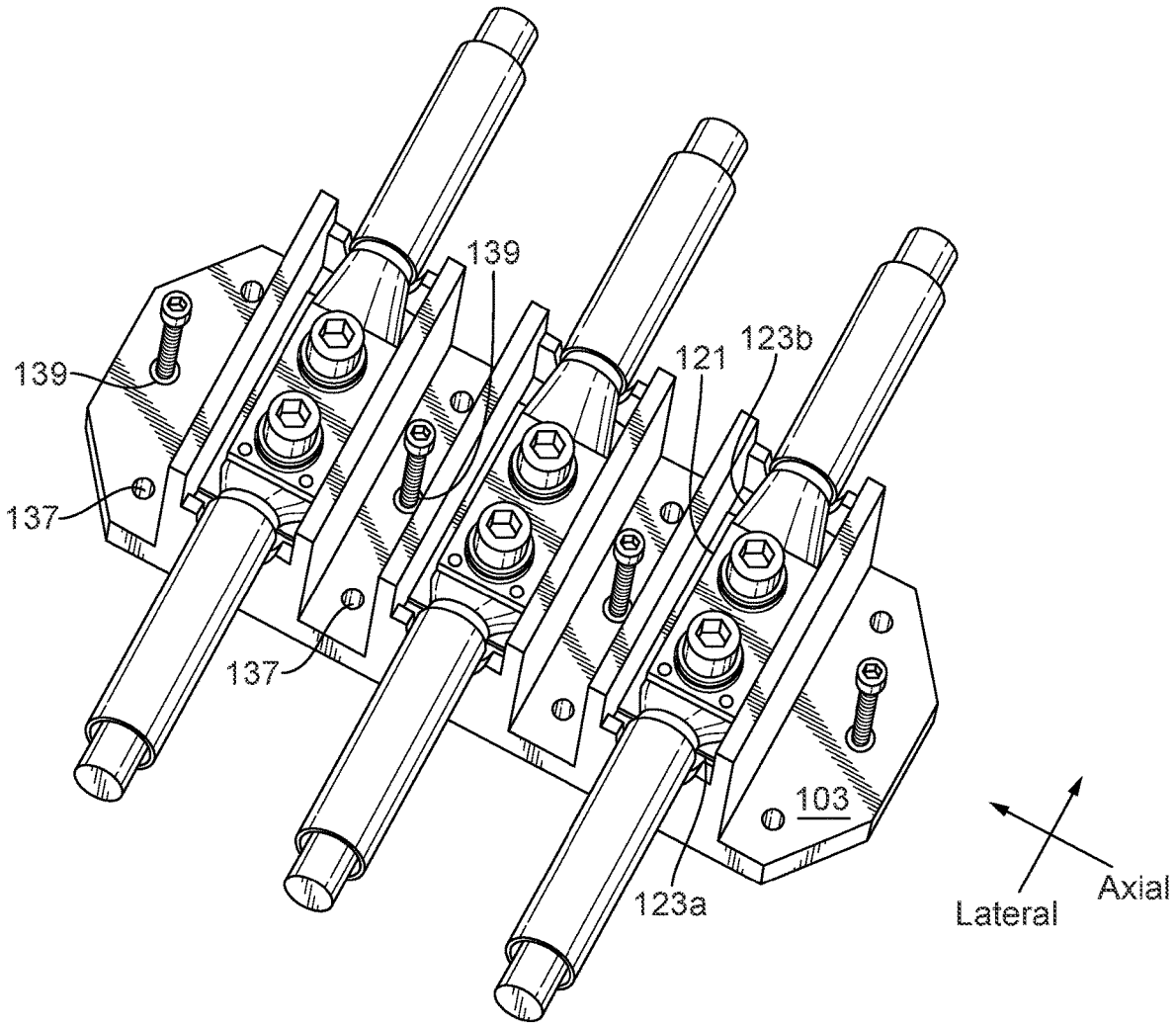
FIG. 4 is a perspective view of the base of FIG. 3, shown having terminal pairs fastened together to a base plate disposed in the base.
Figure 6:
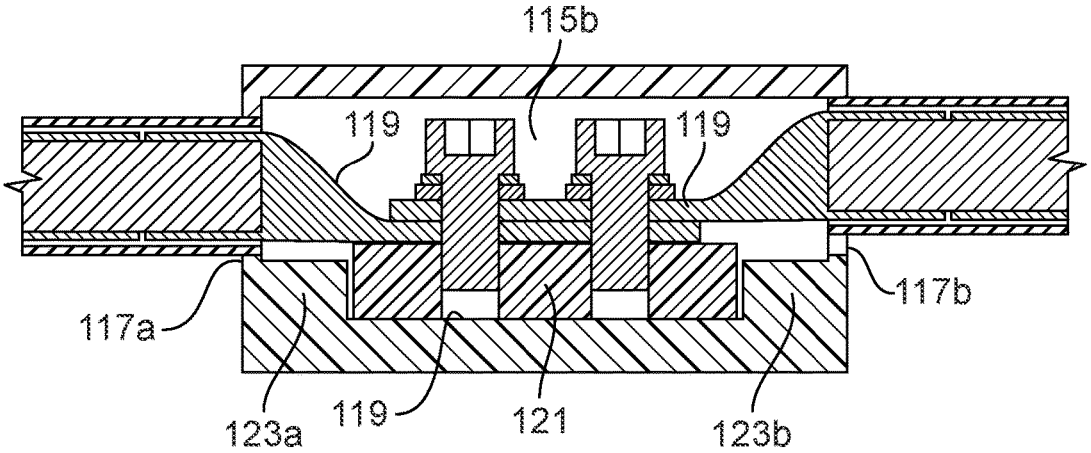
FIG. 6 is a cross-sectional view of the embodiment of FIG. 1, taken along a lateral line.

In accordance with at least one aspect of this disclosure, an aircraft electrical system can include a plurality of pairs of terminals connected together (e.g., as shown in FIGS. 4-6), e.g., within about an inch (e.g., about 1.5 inches in the axial direction) of each other, using any suitable device disclosed herein, e.g., any suitable embodiment as described above. In certain embodiments, the terminals 109 can be high voltage terminals above 235 volts AC or above 270 volts DC (e.g., about 1000 VDC to about 3000 VDC).

Embodiments may be configured to only allow the cover to be installed after correct electrical installation. In certain embodiments, the cover design can be compatible with single phase or multi-phase installations for example, with single bolts or multiple bolted joints. Certain embodiments can be a fixed electrical mechanical mounting with a captive fastener.

In certain embodiments, the terminal openings defined by the base and cover can have a gasket to provide protection and to seal the interface. A gasket seal can be split and be on both top and bottom covers (e.g., like a grommet) or be on the power feeder like a bushing, for example.

Embodiments can provide an elongated and or tortuous creepage path (e.g., the path of least resistance defined by the abutment of the cover and the base), e.g., as shown in FIG. 5, to prevent arcing even with extremely high voltages. Embodiments can prevent a line of sight between conductors/terminals.

The base can be configured to have good dielectric properties, good mechanical strength properties (e.g., a fiber reinforced material) for handling loads, high thermal conductivity for heat rejection to mounting and ambient heat transfer, and high temperature capabilities with about 200 C maximum allowable conductor temperatures. The cover can be configured to have good dielectric properties, moderate mechanical strength because it need not bear a load, moderate flexibility to clamp on feeders/terminal lugs at the terminal opening interface, and may have fins on the surface for improved heat transfer. Embodiments can include a threaded block integrated into the base in a pocket (e.g., glued therein).

Embodiments can include a bolted joint and feeder temperature monitoring for predictive health monitoring. Such temperature measurement devices (e.g. resistive detecting device (RTD) can be installed into the mounting cover as part of a molding or additive manufacturing process. The number of RTD type devices can be dependent on over all configuration as desired. RTD values from operation can be provided to the prognostic health monitoring (PHM) system inside airplane. PHM systems can utilize analytics to detect any impending failure associated with bolted joint. PHM system analytics can monitor temperature growth over a time period and, if the rate of growth is excessive will provide alert. Embodiments can include a small circular cover on the connector for interface I/O. Connector and device wiring can be molded in or part of additive processing or post molding process.

Certain embodiments can include 4/0 AWG copper feeders and 4/0 copper or copper alloy lugs with dual stud configuration, and ⅜" bolts for electrical clamping force and clamping force against vibration inducted loads from feeder. The complete clamped electrical power joints can be metallic. The base plate can be a steel nut plate with threads for bolts, for a robust high temperature electrical clamped joint. The fastener joint to the base plate can have a heavy spring washer for compensation of thermal extremes and thermal cycling. A Belleville-type washer can also be used as pre load device. Bolts can be used as the threaded fastener to have more options of higher strength fastener materials. With the cover installed, there can be no line of sight between conductors and fasteners. The cover and base integrated assembly can provide a labyrinth-type seal between power feeders and feeders to fasteners for very long creepage distances to prevent dielectric failure. The cover and base opening around lug barrel can have a soft grommet seal to provide a dust and liquid seal around each bolted power joint phase. There can be feeder insulation sleeving on lug barrel outside of dielectric enclosure for feeder to feeder line of sight protection and feeder to mounting conductor dielectric protection. The cover assembly can have captive fasteners for installing on to the base assembly to facility installation and mitigate Foreign Object Debris (FOD) risk.

In certain embodiments, the base plate can be non-magnetic for to prevent E-Field effects. The power feeder clamping bolts can be low or non-magnetic high strength material to prevent E-Field effects. In certain embodiments, the base plate can be knurled and epoxied into the housing, or knurled and molded in place. In certain embodiments, each terminal can be protected by cover slots fitting into barriers on all surfaces around the terminal.

In certain embodiments, a power feeder (wire or bus bar) electrical and mechanical connection system can have dual fasteners (threaded studs or bolts) construction, that provides both a high electrical amperage carrying connection (low voltage drop), mechanical strength for severe environment installations (vibration), aerospace high voltage robustness (protection to prevent voltage breakdown), and good thermal performance (minimize thermal losses). The electrical mechanical interface connection design can use double stud feeders for two (2) fasteners going thru the electrical power interfaces. The electrical mechanical interface design can improve electrical conduction to provide mechanical strength for greater resistance to mechanical loading or bending moments from large feeder into the bolted joint. The electrical mechanical interface design can improve thermal conduction for high amperage power level by minimizing voltage drop and heat sink capability of the mounting base.

The mounting base can be of higher thermal conductivity and be used to conduct heat to aircraft structure. In addition it can have cooling fins to increase natural convection from it to ambient for additional cooling. The electrical mechanical interface design can facilitate the electrical connection protection and insulation with integrated barriers and cover for high altitude and high voltage applications. The electrical mechanical interface design mounting base system can allow for the construction to provide for dielectric protection and high voltage in high altitude applications by creating long creepage (surface) distances between conductors and no line of sight between conductors for preventing contamination faults. The dielectric cover assembly can include grooves and barriers, which integrate into the mounting assembly to provide a dielectric enclosure and dust gasket type sealing around the electrical interface conductor(s). Integration of a temperature measurement device(s) can be done for predictive health monitoring of electrical joint performance/degradation. The material construction can be designed for arc resistant materials around the electrical conductors, and tough materials for mechanical strength at the alignment groves/flanges in the installation.

Embodiments can provide multiple fasteners for mechanical support of heavy electrical conductor interfaces against high dynamic loads, larger clamped areas of electrical conductors for high amperage, reduced thermal losses due to reduced voltage drop; increased area for conducting heat away from the electrical joint. Embodiments can provide protection for FOD fault failures, prevention of corona initiation to any metallic mounting surface, protection against creepage arc faults, protection against contamination.

In accordance with at least one aspect of this disclosure, referring additionally to FIGS. 7-10, another embodiment of a power feeder device 700 is shown. In certain embodiments, a power feeder device 700 can be similar or include similar features as the embodiments disclosed above, e.g., device 100, and specifically configured to interface with a bus bar at a chassis and/or one or more bus bars. For example, the power feeder device 700 can include a base 701 having a mounting portion 703 and a plurality of connector structures 705 (e.g., the same as or similar to structures 105 as disclosed above) extending from the mounting portion 703 and spaced apart relative to each other to form a respective gap therebetween. Each connector structure 705 can be configured to receive a respective pair of terminals 719*a*, 719*b* to electrically connect the respective pair of terminals 719*a*, 719*b* within connector structures 705, e.g., and to block a line of sight between adjacent pairs of terminals. It is contemplated that there may be only a single pair of terminals and, therefore, a structure to block line of sight between adjacent terminals may not be necessary.

Figure 7:
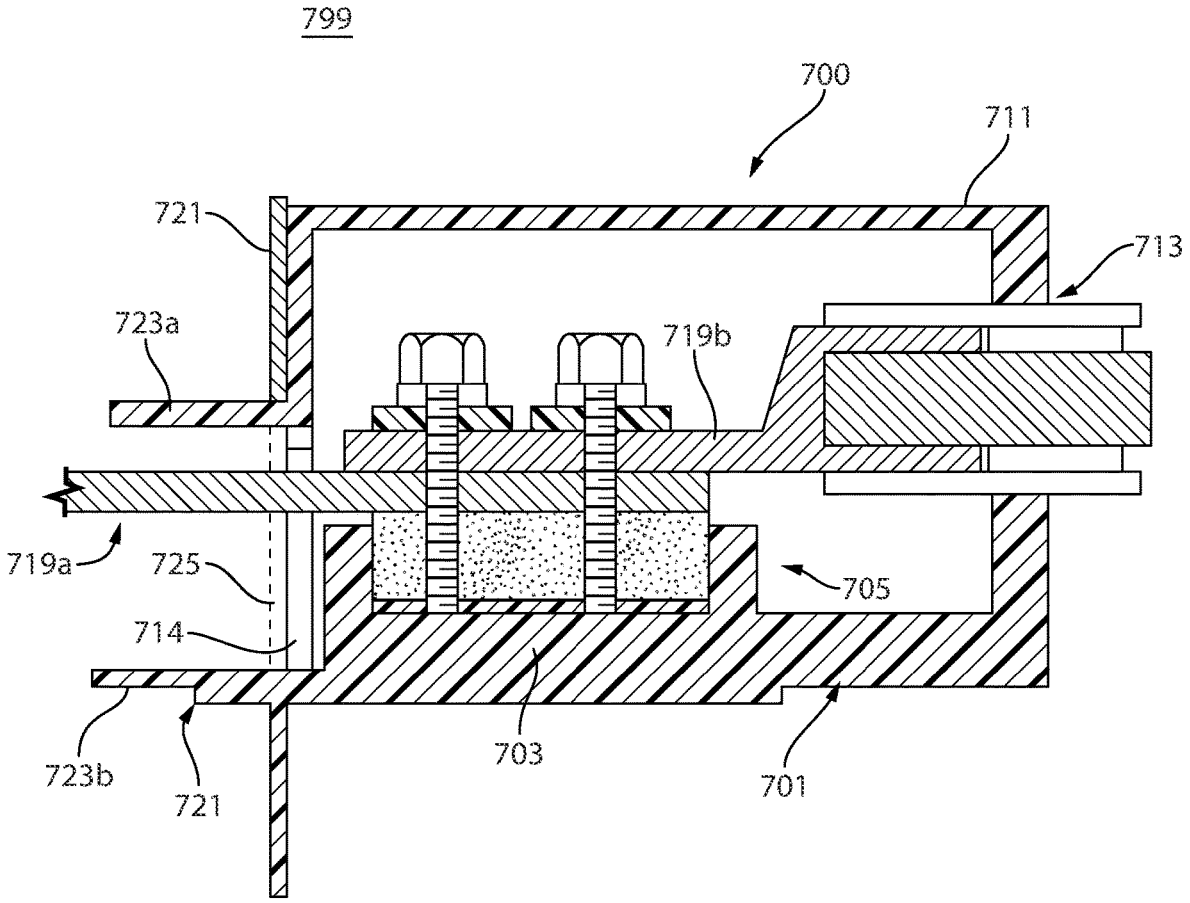
FIG. 7 is a partial cross-sectional view of an embodiment of a system including an embodiment of a device in accordance with this disclosure.
Figure 8:
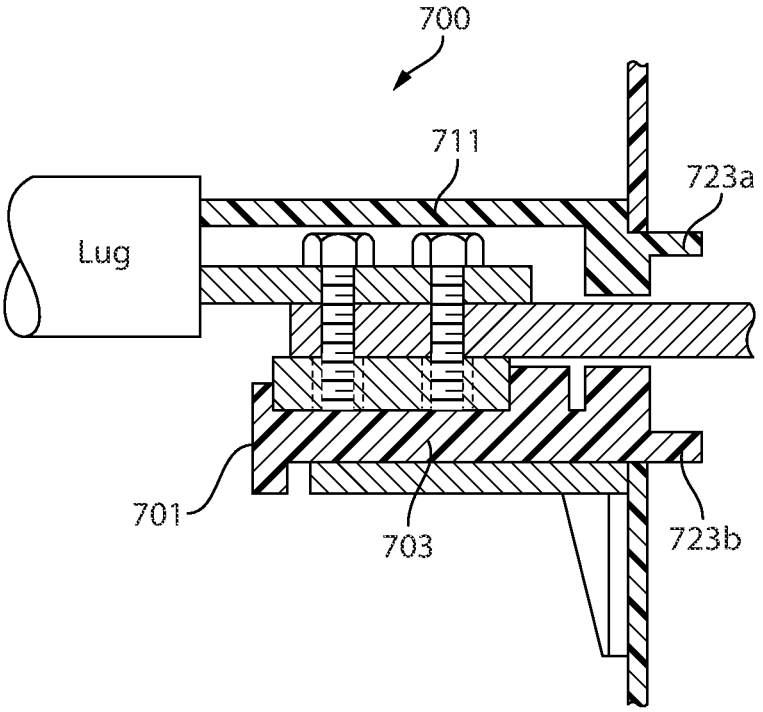
FIG. 8 is a partial reverse side cross-sectional view of the embodiment of FIG. 7.

As shown in FIGS. 7 and 8, The device 700 can also include a cover 711 configured to mate with the base 701 to enclose each of the plurality of connector structures 705 and to increase a length of a creepage path between each pair of terminals 719*a*, 719*b* by at least partially inserting into each gap between the connector structures 705. The base 701 and the cover 711 can be configured to form a terminal opening 713, 714 on each lateral side (left and right sides as shown in FIGS. 7 and 8) when assembled to allow pass-through of a conductor and/or portion of each terminal 719*a*, 719*b*. In certain embodiments, e.g., as shown, at least one of the terminals 719*a* of the respective pair of terminals 719*a*, 719*b* can be a bus bar extending from a bus bar chassis 721.

The base 701 and/or the cover 711 can form a creepage barrier 723*a*, 723*b* that extend into and around a chassis wall opening 725 of the chassis 721 to increase a length of a chassis creepage path from the respective pair of terminals 719*a*, 719*b* (e.g., from the bus bar terminal 719*a*) to the chassis 721. The cover 711 and the base 701 would be made of an electrically insulative and/or dielectric material (e.g., as disclosed above with respect to the embodiment of FIG. 1). As shown, the creepage barrier 723*a*, 723*b* can extend into the chassis 721 any suitable distance (e.g., about a quarter to a half of the width of the device 700) to prevent arcing between the bus bar terminal 719*a* or pair of terminals 719*a*, 719*b* connected together and the chassis housing 721 (which can be made of a conductive material).

The creepage barrier 723*a*, 723*b* can be planar in shape (e.g., a flat extension) in at least one portion, for example. Any suitable shape (e.g., a conduit shape) is contemplated herein. In certain embodiments, the creepage barrier 723*a*, 723*b* can include a first portion 723*b* that extends from the base and a second portion 723*a* that extends from the cover 711. Any suitable portions are contemplated herein (e.g., a single portion extending from the cover 711 or the base 701 only). Each of the plurality of connector structures 705 and/or any other portion of the device 700 can be the same or similar to the device 100 as disclosed above, for example.

In accordance with at least one aspect of this disclosure, a system 799 includes a chassis 721, having a chassis wall opening 725 and a bus bar (e.g., terminal 719*a*) extending through the chassis wall opening 725. The system 799 can also include a power feeder device, e.g., device 700 as disclosed herein, e.g., as described above. For example, at least one of the terminals 719*a* of the respective pair of terminals 719*a*, 719*b* can be the bus bar extending from the chassis 721. The base 701 and/or the cover 711 can form a creepage barrier 723*a*, 723*b*, e.g., as disclosed above.

Figure 9:
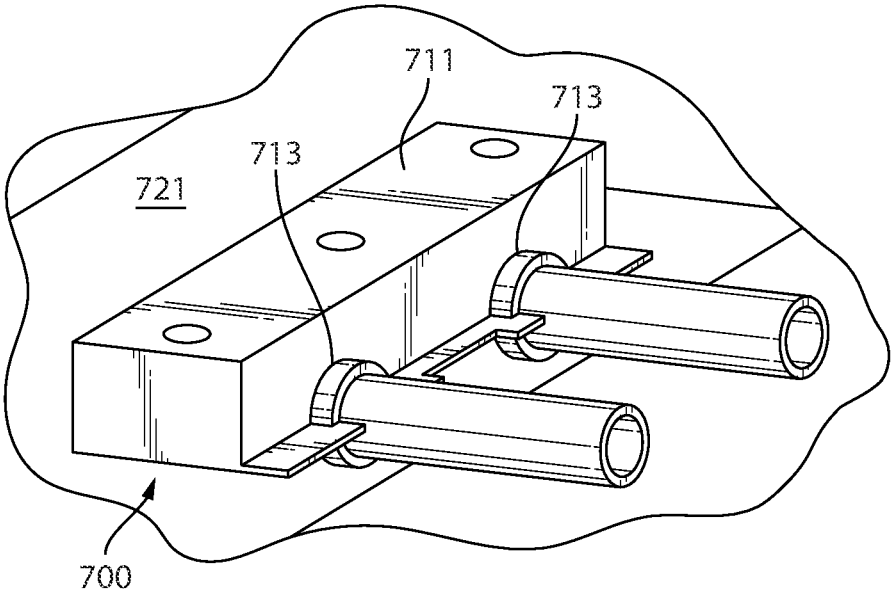
FIG. 9 is a partial perspective view of the embodiment of FIG. 7.

In certain embodiments, e.g., referring to FIG. 9, the power feeder device 700 is mounted (e.g., via one or more fasteners) to the chassis 721. In certain embodiments, the other terminal 719*b* of the respective pair of terminals 719*a*, 719*b* can include a connecting terminal 719*b* configured to connect to the bus bar terminal 719*a*. Accordingly, in certain embodiments, the system can further include the connecting terminal 719*b*.

Figure 10:
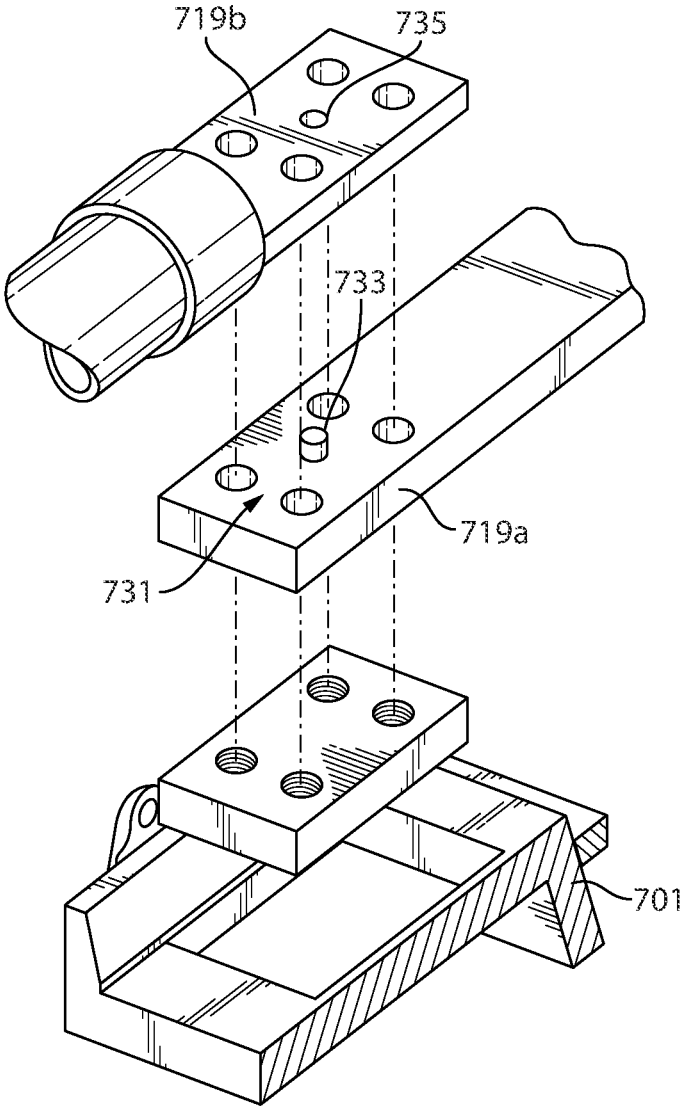
FIG. 10 is an exploded view of an embodiment of an embodiment of a pair of terminals configured to mount within the embodiment of FIG. 7, shown having an embodiment of an alignment system.

As shown in FIG. 10, the bus bar terminal 719*a* and/or the connecting terminal 719*b* can include at least one alignment system 731 such that bus bar terminal 719*a* and connecting terminal 719*b* only mate in a single orientation. In certain embodiments, the alignment system 731 can include at least one protruding alignment feature 733 on the bus bar terminal 719*a* (e.g., which is shown as integral with the bus bar) and/or connecting terminal 719*b* and a receiving alignment feature 735 that mates with the at least one protruding alignment feature 733 on the other of the bus bar terminal 719*b* and/or connecting terminal 719*b*.

In certain embodiments, the system 799 can include a plurality of pairs terminals (e.g., similar a shown in to FIGS. 1-5 and FIG. 9). Each pair can include a respective bus bar extending from the bus bar chassis 721 and a respective connecting terminal configured to connect to each respective bus bar. In certain embodiments, the alignment system 731 can be configured such that if any connecting terminal 719*b* is misplaced on an incorrect bus bar terminal 719*a*, the misplaced connecting terminal will be misaligned relative to a respective terminal opening 713 of the terminal openings 713 formed by the base 701 and cover 711 such that the cover 711 and base 701 cannot install together as the misplaced connecting terminal 719*b* blocks closure (e.g., such that the conductor does not fit within the terminal opening 713).

Any other suitable alignment feature and/or consequence of misalignment is contemplated herein. The terminals 719*a*, 719*b* can include any suitable fastener holes (e.g., four arranged in a square shape, or mounts as appreciated by those having ordinary skill in the art.

In accordance with at least one aspect of this disclosure, a power feeder system, e.g., system 799, can include a base 701, a cover 711 configured to mount with the base 701 to enclose around at least a pair of terminals (e.g., one or more pairs of terminals 719*a*, 719*b*) such that the base 701 and cover 711 form a terminal opening 713 on each lateral side thereof, a bus bar terminal 719*a*, a connecting terminal 719*b* mounted to the bus bar terminal 719*a*, and an alignment system 731 configured to align the bus bar terminal 719*a* and the connecting terminal 719*b* relative to each other. In certain embodiments, the cover 711 cannot close around the base 701 (or otherwise properly mount thereto) with the bus bar terminal 719*a* and connecting terminals 719*b* enclosed therein unless the bus bar terminal 719*a* and the connecting terminal 719*b* are aligned by the alignment system 731. The alignment system 731 can include any suitable embodiment of an alignment system disclosed herein, e.g., as described above.

Embodiments include an electrical power feeder connection terminal block (TB) assembly. Embodiments can be used with a bus bar that terminates directly into electronics. Embodiments can penetrate through the bus bar chassis and have dielectric barrier walls shaped accordingly (e.g., lining and extending into cavity to prevent arcing from bus bar, for example).

Embodiments can include a dielectric cover assembly, over lugs, and a bus bar bolted joint to a nut plate. The cover and base can combine to enclose exposed electrical conductors for personnel protection from voltage or for exposure to contamination from the installation, for example.

In certain embodiments, due to alignment pin features, any mismatch in phases could result in feeder lug misalignment which would not allow installation of cover due to cover terminal opening position. Embodiment can be compatible with one phase or multi-phase installations, with single bolts or multiple bolted joints. The embodiment of FIG. 9 show a two phase feeder, for example.

In certain embodiments, mounting of the cover assembly into mounting base installation encloses component electrical joint. In certain embodiments, mounting of the cover assembly encloses (e.g., surrounds) the electrical interface conductor (wire feeder) and equipment electrical bus bar joint. In certain embodiments, electric feeders pass through in cover can have a compliant dielectric gasket for a dust gasket seal around the electrical conductor insulation jacket, for example (e.g., as shown in FIG. 9).

Embodiments can include a fixed electrical mechanical mounting with a captive fastener. In certain embodiments, mounting installation facilitates the design of a cover for dielectric and creep spacing protection. In certain embodiments, each terminal can be protected by cover slot to groves on all surfaces. In certain embodiments, the bus bar can have an alignment pin and lug that has the associated alignment hole for support during installation and phase keying.

In certain embodiments, the terminal block can have barrier walls for high voltage spacing. In certain embodiments, a thread block can include an integrated nut plate in the pocket.

Embodiments can include a power feeder (e.g., a wire or bus bar) electrical and mechanical connection system having multiple fasteners (threaded studs or bolts) construction, that provides both a high electrical amperage carrying connection (low voltage drop), mechanical strength for severe environment installations (vibration), aerospace high voltage robustness (protection to prevent voltage breakdown), and good thermal performance (minimize thermal losses). Embodiments can include an electrical mechanical interface that can utilize two (2) to four (4) hole feeder lugs for fasteners going thru the electrical power interfaces of the connecting bus bar, improve electrical conduction to provide mechanical strength for greater resistance to mechanical loading or bending moments from large feeder into the bolted joint, improve thermal conduction for high amperage power level by minimizing voltage drop and heat sink capability of the mounting base, facilitates the electrical connection protection and insulation with integrated barriers and cover for high altitude and high voltage applications, and utilize a mounting base system that allows for the construction to provide for dielectric protection and high voltage in high altitude applications by creating long creepage (surface) distances between conductors and no line of sight between conductors for preventing contamination faults.

In certain embodiments, the dielectric cover assembly features of grooves and barriers, which integrate into the mounting assembly to provide a dielectric enclosure and dust gasket type sealing around the electrical interface conductor(s). Certain embodiments can integrate a temperature measurement device to use for predictive health monitoring of electrical joint performance/degradation. In certain embodiments, the material construction can be designed for arc resistant materials around the electrical conductors, and tough materials for mechanical strength at the alignment groves/flanges in the installation.

Embodiments can include a wire to equipment bus bar electrical mechanical connection system for large wire sizes having multiple fasteners that provides mechanical strength for severe environment installations and high electrical amperage connection with high voltage protection. Embodiments can improve electrical connection to provide greater mechanical strength for resistance to mechanical loading from large feeder at the bolted joint. Embodiments of an interface design can improve thermal performance for high amperage power level by minimizing voltage drop and improving heat sink capability of the assembly. Embodiments of an interface design can provide dielectric and high voltage in high altitude application protection by integrated protection between conductors, with groves and barriers features, and no line of sight between exposed conductors to prevent electrical faults. Embodiments of a dielectric cover assembly can include grooves and barriers, which integrate into the mounting base assembly and chassis, and can combine to provide a dielectric enclosure and gasket sealing around the electrical interface conductors.

Embodiments can directly connect the power feeder cable to the electrical bus bar conductor of the power unit or equipment. Mounting base insulation can provide protection for FOD fault failures, prevention of corona initiation to any metallic mounting surface, protection against surface arc faults, protection against contamination/environment pollutions. In certain embodiments, the integrated assembly of interconnection and cover provides for dielectric protection of electrical conductors.

In certain embodiments, the design complexity (protection features) of the protection cover can be based on severity of the component installation, for example a stand alone component in an un-pressurized location can require a greater level or protection/sealing/robustness compared to a low voltage personnel protection cover. Embodiments of an insulation cover can provide protection of feeders for personnel protection in aircraft, protection for FOD fault, prevention of corona initiation in high voltage high altitude, protection against arc faults, protection against contamination, and can be configured for aircraft feeder design to bus bars in electrical power distribution equipment Embodiments can provide no line-of-sight between exposed conductive elements (power conductors or structure), barriers and grooves to provide labyrinth path between conductor for large creepage distance, dust gasket sealed enclosure which provides for protection against contamination at the electrical conductor, a cover that provides a location to place a temperature monitor for leading indication of bolt joint issues due to increase voltage drop or damage, and a mounting base that provides a mechanism for heat sink to structure of heat generated by thermal losses in the feeder, crimp joint, and bolted joint.

In certain embodiments, the cover material design can be optimized by using additive material manufacturing process and using materials with very high resistance to arc tracking as surface treatment of the cover adjacent to all the electrical conductor elements, and use more flexible materials for the bulk material and areas requiring different strength properties. In certain embodiments, the dielectric protection cover assembly fasteners could be installed captive in the cover (retained) so that the fasteners are not handled loose for remove and replacement (R&R) activity, to reduce the risk of FOD. In certain embodiments, the cover utilizes captive hardware for installation. In certain embodiments, the electrical mechanical interconnection assembly can be configured for singe phase (e.g. DC, or single terminal electrical joint) or multiple phase (2 phase (e.g. +/− DC), 3 phase, or 6 phase AC designs, etc.).

As system voltages and currents increase, aircraft manufacturers may need to improve the manufacturing and routing of large power feeders with the new higher amperage levels, higher voltage levels, and harsh environments (with contaminations present). By integrating the dielectric cover assembly geometry and materials for feeder electrical terminal protection system, the applications of high current, high voltage, and heavy electrical feeders can be designed for aerospace applications with greatly improved capability over present low voltage designs.

The standard feeder component for aerospace products are at the power level of 400 A (per phase) at the limit of standard American Wire Gauge (AWG) sizing. New aerospace applications are expanding the power level to several thousands of amps, for example, which will have feeder sizes specified in cross sectional area. The high amperage levels, high voltage levels, high altitude levels, harsh environments will become more common application environment for systems like electrical propulsion on aircraft or high amperage/high voltage/harsh environments for electric train systems. By integrating the electrical and mechanical connection system the applications of high current, high voltage, and heavy electrical feeders can be designed for aerospace applications.

These complications (feeder physical size, amperage heating, harsh environment) will become the more common environment for systems like electrical propulsion on aircraft. Embodiments provide physical protection against arcing, break down, and safety. Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A power feeder device, comprising:

a base, comprising:

a mounting portion; and a plurality of connector structures extending from the mounting portion and spaced apart relative to each other to form a respective gap therebetween, each connector structure configured to receive a respective pair of terminals to electrically connect the respective pair of terminals within connector structures and to block a line of sight between adjacent pairs of terminals; and a cover configured to mate with the base to enclose each of the plurality of connector structures and to increase a length of a creepage path between each pair of terminals by at least partially inserting into each gap between the connector structures, wherein the base and the cover are configured to form a terminal opening on each lateral side when assembled to allow pass-through of a conductor and/or portion of each terminal, wherein at least one of the terminals of the respective pair of terminals is a bus bar extending from a bus bar chassis, wherein the base and/or the cover form a creepage barrier that extend into a chassis wall opening of the bus bar chassis to increase a length of a chassis creepage path from the respective pair of terminals to the bus bar chassis.

2. The device of claim 1, wherein the creepage barrier is planar in shape in at least one portion.

3. The device of claim 1, wherein the creepage barrier includes a first portion that extends from the base and a second portion that extends from the cover.

4. The device of claim 1, wherein each of the plurality of connector structures includes first and second barrier walls extending from the mounting portion and axially spaced apart to block a line of sight to an adjacent connector structure.

5. The device of claim 4, wherein each of the plurality of connector structures includes first and second lateral walls extending from the mounting portion and laterally spaced apart.

6. The device of claim 5, wherein each of the first and second lateral walls connect respective first and second barrier walls, and extend only partially the height of each barrier wall.

7. The device of claim 6, wherein each lateral wall defines a cutout shape that forms a portion of a respective terminal opening.

8. The device of claim 7, wherein the cutout shape is semi-circular.

9. The device of claim 7, wherein each of the plurality of connector structures defines a base plate pocket between the barrier walls and the lateral walls, wherein each plate pocket is configured to receive a respective base plate for a respective pair of terminals to mount to.

10. The device of claim 9, wherein the base plate pocket is defined laterally inward from the lateral walls and separated from the lateral walls by a separator portion.

11. A system, comprising:

a bus bar chassis having a chassis wall opening and a bus bar extending through the chassis wall opening; and a power feeder device having:

a base, comprising:

a mounting portion; and a plurality of connector structures extending from the mounting portion and spaced apart relative to each other to form a respective gap therebetween, each connector structure configured to receive a respective pair of terminals to electrically connect the respective pair of terminals within connector structures and to block a line of sight between adjacent pairs of terminals; and a cover configured to mate with the base to enclose each of the plurality of connector structures and to increase a length of a creepage path between each pair of terminals by at least partially inserting into each gap between the connector structures, wherein the base and the cover are configured to form a terminal opening on each lateral side when assembled to allow pass-through of a conductor and/or portion of each terminal, wherein at least one of the terminals of the respective pair of terminals is the bus bar extending from the bus bar chassis, wherein the base and/or the cover form a creepage barrier that extend into the chassis wall opening of the bus bar chassis to increase a length of a chassis creepage path from the respective pair of terminals to the bus bar chassis.

12. The system of claim 11, wherein the power feeder device is mounted to the bus bar chassis.

13. The system of claim 11, wherein the other terminal of the respective pair of terminals includes a connecting terminal configured to connect to the bus bar, the system further comprising the connecting terminal.

14. The system of claim 13, wherein the bus bar and/or the connecting terminal includes at least one alignment system such that bus bar and connecting terminal only mate in a single orientation.

15. The system of claim 14, wherein the alignment system includes:

at least one protruding alignment feature on the bus bar and/or connecting terminal; and a receiving alignment feature that mates with the at least one protruding alignment feature on the other of the bus bar and/or connecting terminal.

16. The system of claim 15, wherein the system further includes a plurality of pairs terminals, wherein each pair includes a respective bus bar extending from the bus bar chassis and a respective connecting terminal configured to connect to each respective bus bar.

17. The system of claim 16, wherein the alignment system is configured such that if any connecting terminal is misplaced on an incorrect bus bar, the misplaced connecting terminal will be misaligned relative to a respective terminal opening of the terminal openings formed by the base and cover such that the cover and base cannot install together as the misplaced connecting terminal blocks closure.

18. A power feeder system, comprising:

a base;

a cover configured to mount with the base to enclose around at least a pair of terminals, wherein the base and cover form a terminal opening on each lateral side thereof;

a bus bar terminal;

a connecting terminal mounted to the bus bar terminal; and an alignment system configured to align the bus bar terminal and the connecting terminal relative to each other, wherein the cover cannot close around the base with the bus bar terminal and connecting terminals enclosed therein unless the bus bar terminal and the connecting terminal are aligned by the alignment system, wherein the alignment system includes:

at least one protruding alignment feature on the bus bar and/or connecting terminal; and a receiving alignment feature that mates with the at least one protruding alignment feature on the other of the bus bar and/or connecting terminal.

19. The system of claim 18, wherein the system further includes a plurality of pairs of terminals, wherein each pair includes a respective bus bar extending from a bus bar chassis and a respective connecting terminal configured to connect to each respective bus bar.

* * * * *